US011397409B2

(12) United States Patent
Wölfle et al.

(10) Patent No.: US 11,397,409 B2
(45) Date of Patent: Jul. 26, 2022

(54) BALANCE SPRING WITH RHOMBOIDAL CROSS-SECTION FOR A MECHANICAL MOVEMENT OF A WATCH, AND METHOD FOR PRODUCING THE BALANCE SPRING

(71) Applicant: MAXON INTERNATIONAL AG, Sachseln (CH)

(72) Inventors: Heinrich Wölfle, Waldkirch (DE); Bruno Schindler, Staufen (DE); Michael Streicher, Emmendingen (DE)

(73) Assignee: MAXON INTERNATIONAL AG, Sachseln (CH)

( * ) Notice: Subject to any disclaimer, the term of this patent is extended or adjusted under 35 U.S.C. 154(b) by 353 days.

(21) Appl. No.: 16/624,795

(22) PCT Filed: Jun. 19, 2018

(86) PCT No.: PCT/EP2018/066214
§ 371 (c)(1),
(2) Date: Dec. 19, 2019

(87) PCT Pub. No.: WO2018/234290
PCT Pub. Date: Dec. 27, 2018

(65) Prior Publication Data

US 2020/0192293 A1 Jun. 18, 2020

(30) Foreign Application Priority Data

Jun. 20, 2017 (EP) ..... 17176933

(51) Int. Cl.
*G04B 17/06* (2006.01)

(52) U.S. Cl.
CPC ..... *G04B 17/066* (2013.01)

(58) Field of Classification Search
CPC ..... G04B 17/066
See application file for complete search history.

(56) References Cited

U.S. PATENT DOCUMENTS

2013/0286795 A1 10/2013 Conus et al.
2015/0124569 A1 5/2015 Decosterd
2015/0124572 A1 5/2015 Decosterd

FOREIGN PATENT DOCUMENTS

CH 704 686 A1 9/2012
CH 704686 A1 9/2012
(Continued)

OTHER PUBLICATIONS

International Search Report and Written Opinion for International Application No. PCT/EP2018/066214 dated Jun. 20, 2017.
(Continued)

*Primary Examiner* — Moshe Wilensky
(74) *Attorney, Agent, or Firm* — Crowell & Moring LLP

(57) ABSTRACT

The present invention relates to a balance spring for a mechanical movement of a watch, wherein the balance spring is embodied as a spiral spring and has a winding cross section. It is provided according to the invention that the winding cross section of the spiral spring is in the shape of a rhombus, wherein the rhombus has four sides, two first corners with a first internal angle, two second corners with a second internal angle, a first diagonal, connecting the two first corners to one another, and a second diagonal, connecting the two second corners to one another, the first diagonal being shorter than the second diagonal, and the first internal angle being larger than the second internal angle.

20 Claims, 5 Drawing Sheets

(56) References Cited

FOREIGN PATENT DOCUMENTS

Figure 1:
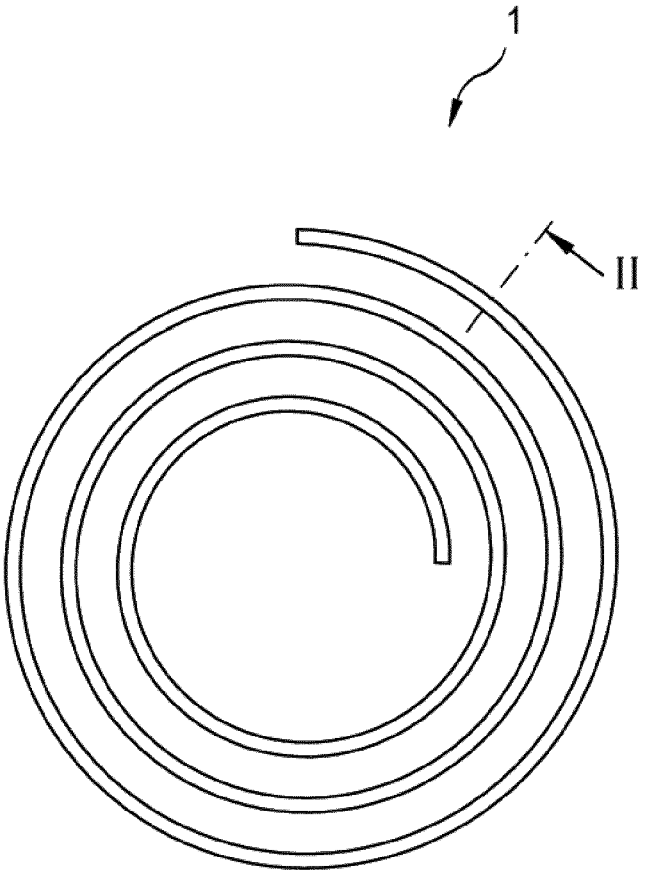

| | | | |
|---|---|---|---|
| CH | 708 272 | B1 | 1/2015 |
| CN | 103299245 | A | 9/2013 |
| CN | 204229119 | U | 3/2015 |
| CN | 204270011 | U | 4/2015 |
| DE | 10 2008 029 429 | A1 | 4/2009 |
| EP | 2 685 325 | A1 | 1/2014 |
| EP | 2685325 | A1 | 1/2014 |

OTHER PUBLICATIONS

Chinese Office Action and Search Report, including translation, in corresponding application No. 201880041465.8 dated Oct. 30, 2020 (9 pages).

BALANCE SPRING WITH RHOMBOIDAL CROSS-SECTION FOR A MECHANICAL MOVEMENT OF A WATCH, AND METHOD FOR PRODUCING THE BALANCE SPRING

This application claims the benefit under 35 U.S.C. § 371 of International Application No. PCT/EP2018/066214, filed Jun. 19, 2018, which claims the priority of European Patent Application No. 17176933.4, filed Jun. 20, 2017, which are incorporated by reference herein in their entirety.

The present invention relates to a balance spring for a mechanical movement of a watch according to the preamble of the independent claim 1. In particular, the invention relates to a balance spring for a mechanical movement of a wristwatch or a pocket watch. A balance spring of the generic type is embodied as a spiral spring and has a winding cross section. The winding cross section is understood to be the cross section of a single winding of the balance spring, not the cross section of the complete balance spring. The balance spring together with the so-called escapement forms the regulating element of a mechanical movement and therefore has a direct influence on uniform clocking and the precision of the mechanical movement.

DE 10 2008 029429 A1 discloses a balance spring according to the preamble of the independent claim. The winding cross section of this spring is embodied as a rectangle.

The object of the present invention is to advantageously further refine a balance spring of the generic type.

This object is achieved through the features of independent claim 1. Therefore, the balance spring according to the preamble of independent claim 1 achieves the object of the invention if the winding cross section of the spiral spring is in the shape of a rhombus, such that the rhombus has at least four sides, two corners with a first internal angle, two second corners with a second internal angle, a first diagonal, connecting the two first corners to one another, and a second diagonal, connecting the two second corners to one another, the first diagonal being shorter than the second diagonal, and the first internal angle being larger than the second internal angle.

The present invention offers the advantage that the distribution of stresses and the unidirectional oscillations of the balance spring are optimized due to the rhomboid geometry. The rhomboid cross section also has a self-centering effect on the movement sequence of the balance spring and stabilizes the balance spring in the plane of oscillation. Due to the design of the rhomboid profile, it is possible to vary the geometrical moment of inertia of the spiral spring and thus to vary the spring rate. The clocking of the movement can thus be established precisely by defining the geometry of the rhomboid cross section accordingly. The first shorter diagonal of the rhombus preferably runs parallel to the plane of extent of the balance spring. The second longer diagonal is therefore preferably perpendicular to the plane of extent of the balance spring. The second longer diagonal therefore preferably runs parallel to one axis of the spiral.

Advantageous embodiments of the present invention are the subject matter of the dependent claims.

In a particularly preferred embodiment of the present invention, the two second corners of the rhombus, which are connected to one another by the second diagonal, are cut parallel to the first diagonal, so that the rhombus has two additional sides. Therefore, for one thing, the spring rate can be established extremely easily and precisely in the design of the geometry of the cross section. Secondly, the manufacture of the balance spring is simplified in this embodiment.

According to another preferred embodiment of the present invention, the distance between the two aforementioned additional sides is between 0.05 mm and 0.2 mm. Therefore, the die balance spring according to the invention is particularly suitable for the movement of a watch.

According to another preferred embodiment of the present invention, the two additional sides are between 0.01 mm and 0.05 mm long. Furthermore, the length of the first diagonal is preferably between 0.03 mm and 0.07 mm. In addition, a value between 3° and 30° has preferably proven to be particularly advantageous for the second internal angle of the cross section of the profile. Furthermore, the second internal angle is preferably between 10° and 30°.

Production of the balance spring according to the invention is greatly simplified if, in another preferred embodiment of the present invention, the transition between the two additional sides and the respective adjacent sides of the rhombus is curved. The radius of the curve is additionally preferably in the range between 0.005 mm and 0.05 mm.

In another preferred embodiment of the present invention, the winding cross section is designed to be symmetrical with respect to the first diagonal of the rhombus and also with respect to the second diagonal of the rhombus. Therefore, the spring rate can be determined easily and precisely in particular. This embodiment also has an advantageous effect on production of the balance spring according to the invention.

According to another particularly preferred embodiment of the present invention, the balance spring is made of a ceramic material. First of all, this yields particularly precise spring properties. Secondly, this choice of material permits a particularly simple method of varying the winding cross section and thus permits a particularly simple method of varying production. A glass ceramic is especially suitable for producing the balance spring according to the invention. An example of a suitable glass ceramic is the glass ceramic material distributed by Schott AG under the brand name Zerodur. Alternatively, the balance spring can also be manufactured from an oxide ceramic, such as zirconium oxide.

The present invention also makes available a method for manufacturing the balance spring according to the invention. In the method according to the invention, the balance spring is manufactured from an unmachined part, which is made of a ceramic material and is structured by a selective laser ablation method, so that the desired winding cross section is achieved. The method according to the invention offers the advantage that balance springs with various winding cross section and thus also various spring properties can be produced from one and the same base body. This eliminates complex and cost-intensive production of different cast shapes.

The unmachined part is preferably a disk. More preferably, the disk is designed to be round. The unmachined part more preferably has a thickness of 0.1 mm to 0.25 mm.

The unmachined part is made of a ceramic, preferably a glass ceramic. In particular the unmachined part may be made of the material distributed by Schott AG under the brand name Zerodur. Alternatively, the unmachined part may also be made of an oxide ceramic. Zirconium oxide is suitable for this in particular. The unmachined part can be produced by the injection molding method.

According to a particularly preferred embodiment of the method according to the invention, a first V-shaped groove is created by using a laser on a first side of the unmachined part, and a second V-shaped groove is also created by means of a laser on the opposite second side of the unmachined part, such that the first and second grooves are opposite and congruent to one another and together form an opening which separates the individual windings of the spiral spring from one another. The first and second grooves are preferably created one after the other in the two opposing sides of the unmachined part, so that the unmachined part is simply turned over after the first groove has been created, so that the second groove can be created using one and the same laser apparatus. The depth of the first groove preferably amounts to slightly more than half of the thickness of the material of the unmachined part used, so that the opening can be produced easily by cutting the second groove in the unmachined part down to at least half the thickness of the material of the unmachined part.

In another preferred embodiment of the method according to the invention, an ultrashort pulse laser is used to perform the selective laser ablation method. Therefore, precise removal of material without leaving any residue is possible without a problematical transfer of heat.

The present invention also makes available a movement for a watch using a balance spring according to the invention.

One embodiment of the present invention is explained in greater detail below with reference to the drawings.

Figure 2:
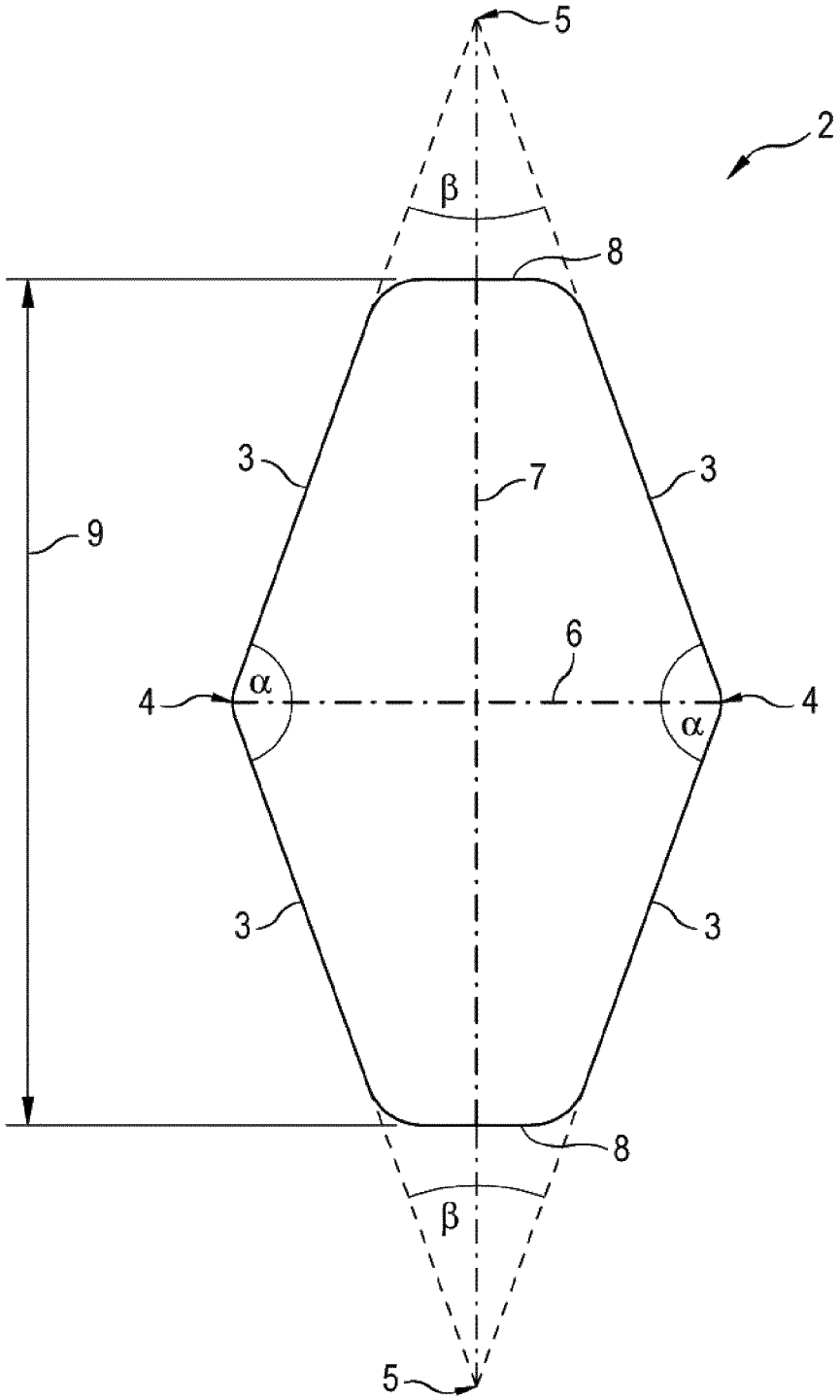
Figure 3:
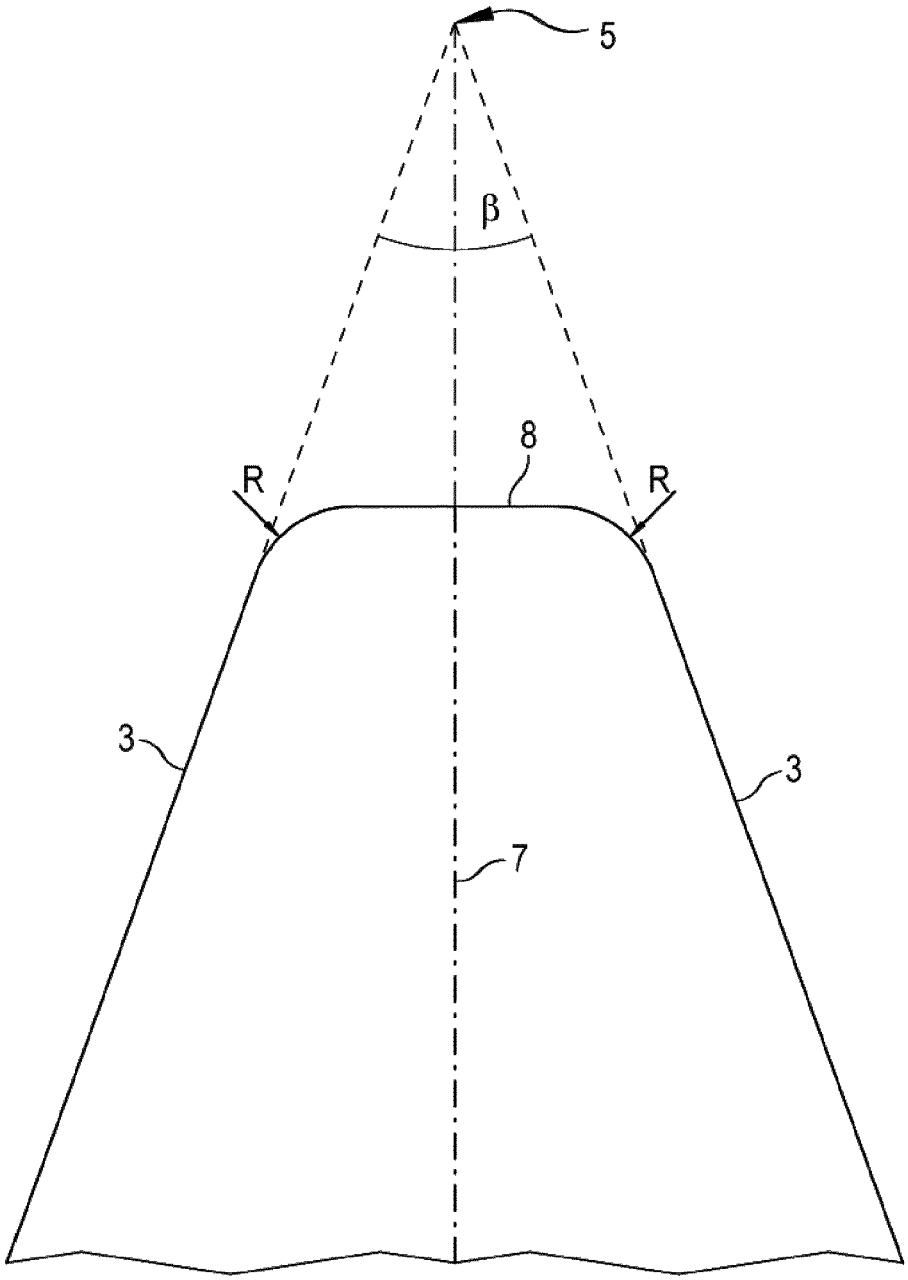
Figure 4:
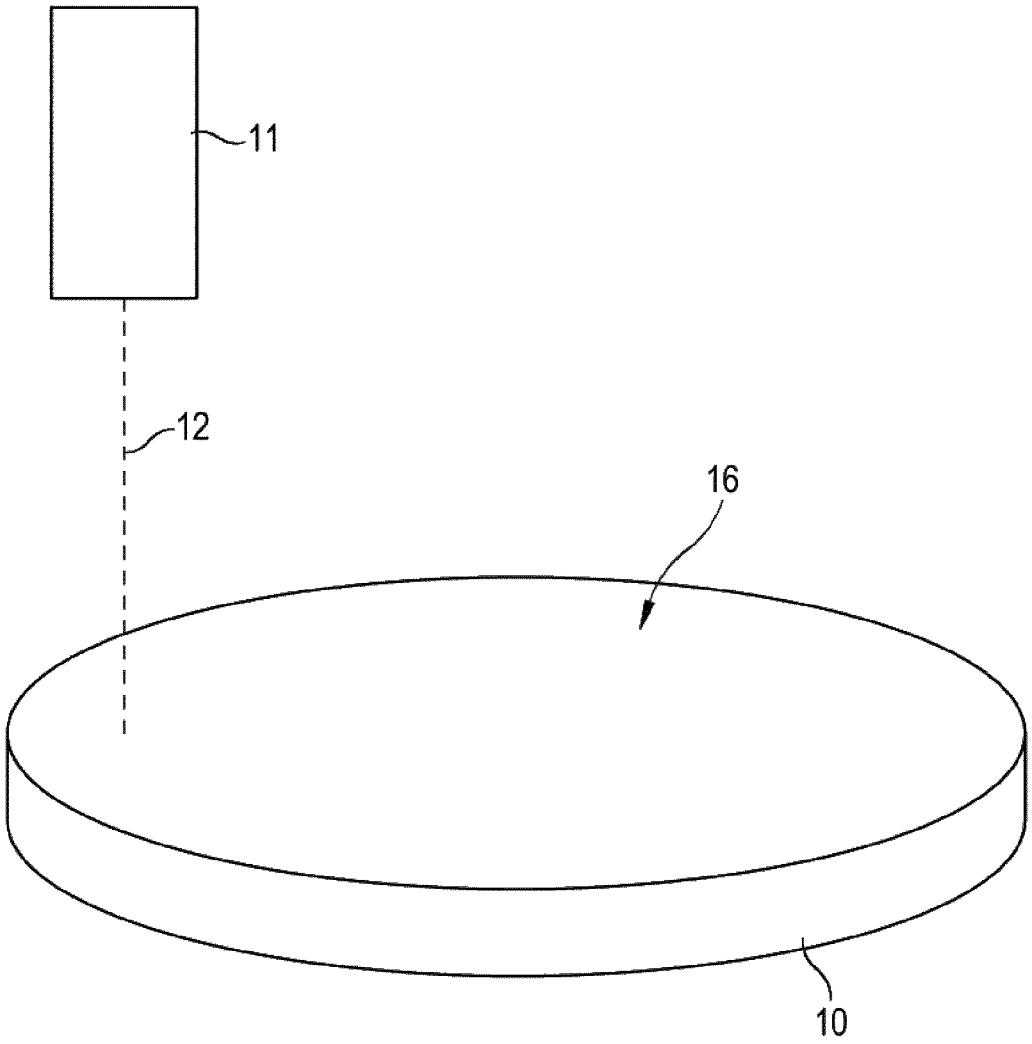
Figure 5:
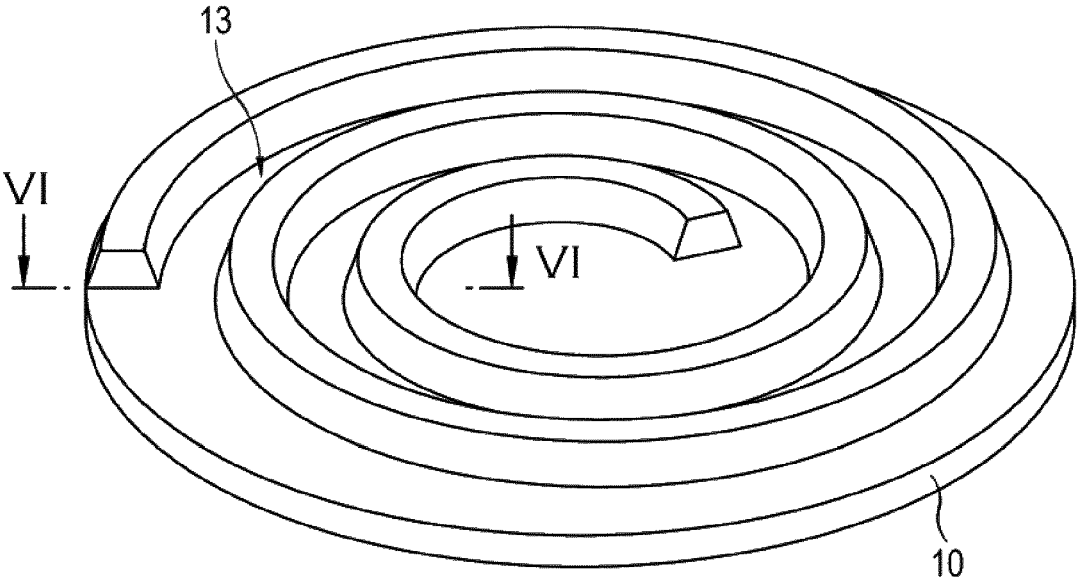
Figure 6:
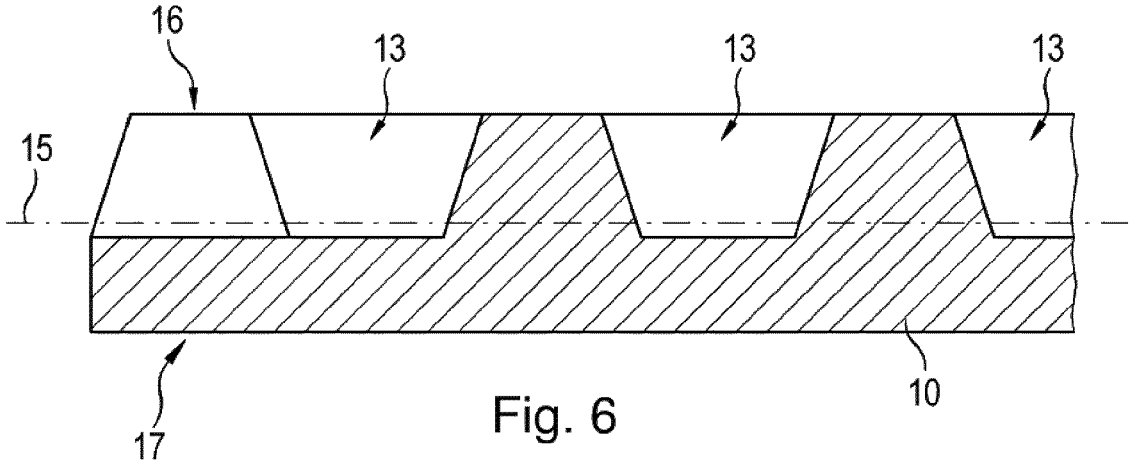
Figure 7:
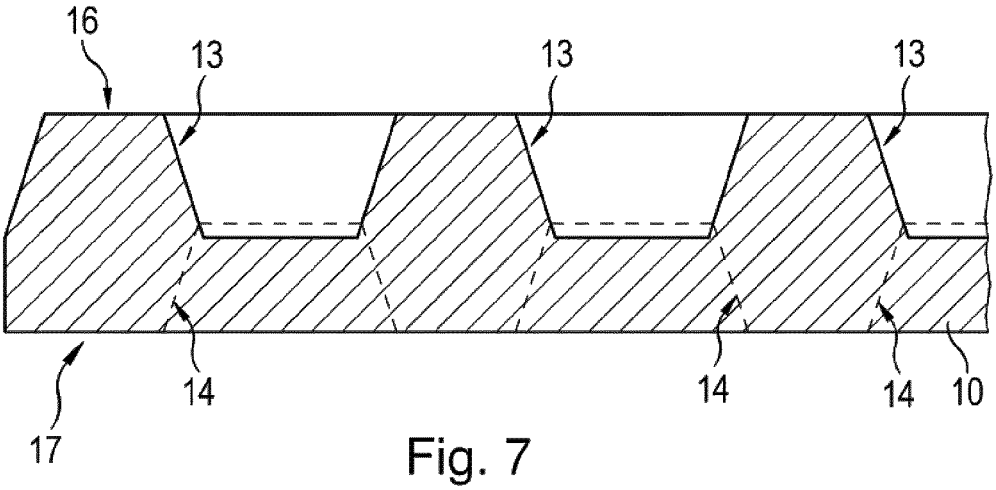

The drawings show:

FIG. 1: an embodiment of a balance spring according to the invention in a view from above, FIG. 2: the winding cross section of the balance spring according to the invention from FIG. 1 according to sectional line II marked in FIG. 1, FIG. 3: a detailed view of a corner of the cross-sectional profile from FIG. 2, FIG. 4: an unmachined part in the form of a disk, from which the balance spring according to the invention is produced, in an oblique view, FIG. 5: the disk from FIG. 4 after creating a V-shaped groove in the top side of the disk, FIG. 6: a section through the disk from FIG. 5 along sectional line VI from FIG. 5, and FIG. 7: the section from FIG. 6 showing the second groove with dashed lines on the bottom side of the disk.

In the following discussion, the same parts are labeled with the same reference numerals. If a figure contains reference numerals that are not explained in detail in the description of the respective figure, reference is made to the previous description of a figure or to the next.

FIG. 1 shows a top view of one embodiment of a balance spring 1 according to the invention. The spiral shape of the balance spring can be seen clearly in this view.

The winding cross section of the balance spring 1 is the same over the entire length of the spring body. A sectional plane II has been drawn in FIG. 1 merely as an example. The respective winding cross section is shown in FIG. 2. As indicated by this figure, the winding cross section 2 is essentially in the form of a rhombus. The basic shape of the rhombus has four sides 3, two first corners 4 with a first internal angle $\alpha$, two second corners 5 with an internal angle $\beta$, a first diagonal 6, connecting the two first corners to one another, and a second diagonal 7, connecting the two second corners to one another. The first diagonal 6 of the basic shape is shorter than the second diagonal 7.

The actual winding cross section is obtained only by cutting off the two second corners 5 parallel to the first diagonal 6. The actual winding cross section therefore has a total of six sides, not just four. The two additional sides resulting from cutting the basic rhomboid body are labeled with reference numeral 8 in the drawing.

According to the invention, the distance 9 between the two additional sides 8 advantageously amounts to between 0.05 mm and 0.2 mm. The two additional sides 8 also preferably have a length between 0.01 mm and 0.05 mm. The length of the first diagonal is also preferably between 0.03 mm and 0.07 mm. The second internal angle $\beta$ is also preferably between 3° and 30°. In the embodiment shown here, the second internal angle is approximately 30°.

To simplify production of the balance spring according to the invention, the transition between the two additional sides 8 and the respective adjacent sides 3 of the rhombus is curved. The radius R of the curve is between 0.005 mm and 0.05 mm, as can be seen clearly in FIG. 3.

In the embodiment shown here, the two second opposing corners 5 are each cut at the same height, resulting in a winding cross section that is designed to be symmetrical with respect to the first diagonal 6 and also with respect to the second diagonal 7.

The method of producing the balance springs according to the invention is described below. The balance spring is manufactured from an unmachined part, which is made of a ceramic material. An unmachined part made of a glass ceramic is preferably used.

The unmachined part is a circular disk 10, which is shown in an oblique view in FIG. 4. The disk 10 is structured by means of a selective laser ablation method, so as to yield the desired winding cross section. To do so, a first V-shaped groove 13 is first created in the top side 16 of the disk 10 by the laser beam 12 of an ultrashort pulse laser 11. The groove 13 can be seen in FIG. 5 as well as in the sectional diagram in FIG. 6. The V-shaped groove 13 marks the interspace between the subsequent windings of the balance spring and is therefore designed as a spiral itself. As shown in FIG. 6, the depth of the groove amounts to slightly more than half the thickness of the material of the disk 10. In FIG. 6, the base of the groove is therefore below line 15, which marks the center of the ceramic disk 10.

After the first groove 13 has been created in the top side 16 of the disk 10, the disk 10 is turned over, so that the bottom side 17 of the disk can be structured with the laser 11. Then a V-shaped groove is also created in the bottom side 17 by means of the laser. This second V-shaped groove is indicated with dashed lines in FIG. 7 and is labeled with reference numeral 14. The two V-shaped grooves 13 and 14 are congruent and together form an opening that separates the individual windings of the spiral balance spring from one another.

The invention claimed is:

1. A balance spring for a mechanical movement of a watch, wherein the balance spring is embodied as a spiral spring and has a winding cross section, wherein the winding cross section of the spiral spring is in the shape of a rhombus, the rhombus having at least four sides, two first corners with a first internal angle $\alpha$, two second corners with a second internal angle $\beta$, a first diagonal, connecting the two first corners to one another, and a second diagonal, connecting the two second corners to one another, wherein the first diagonal is shorter than the second diagonal, and wherein the first internal angle is larger than the second internal angle.

2. The balance spring according to claim 1, wherein the two second corners, which are connected to one another by the second diagonal, are cut parallel to the first diagonal, so that the rhombus has two additional sides.

3. The balance spring according to claim 2, wherein the distance between the two additional sides is between 0.05 mm and 0.2 mm.

4. The balance spring according to claim 2, wherein the two additional sides have a length between 0.01 mm and 0.05 mm.

5. The balance spring according to claim 2, wherein the length of the first diagonal is between 0.03 mm and 0.07 mm.

6. The balance spring according to claim 2, wherein the second internal angle β is between 3° and 30°.

7. The balance spring according to claim 6, wherein the second internal angle β is between 10° and 30°.

8. The balance spring according to claim 2, wherein the transition between the two additional sides and the respective adjacent sides of the rhombus is curved, the radius (R) of the curve being between 0.005 mm and 0.05 mm.

9. The balance spring according to claim 1, wherein the winding cross section is designed to be symmetrical with respect to the first diagonal of the rhombus as well as with respect to the second diagonal of the rhombus.

10. The balance spring according to claim 1, wherein the balance spring is made of a ceramic material.

11. The balance spring according to claim 10, wherein the ceramic material comprises a glass ceramic.

12. The balance spring according to claim 2, wherein the winding cross section is designed to be symmetrical with respect to the first diagonal of the rhombus as well as with respect to the second diagonal of the rhombus.

13. The balance spring according to claim 2, wherein the balance spring is made of a ceramic material.

14. The balance spring according to claim 13, wherein the ceramic material comprises a glass ceramic.

15. A movement for a watch comprising:

a spiral spring having a winding cross section, wherein the winding cross section of the spiral spring is in the shape of a rhombus, the rhombus having at least four sides, two first corners with a first internal angle α, two second corners with a second internal angle β, a first diagonal, connecting the two first corners to one another, and a second diagonal, connecting the two second corners to one another, wherein the first diagonal is shorter than the second diagonal, and wherein the first internal angle is larger than the second internal angle.

16. A method for manufacturing a balance spring, wherein the balance spring is embodied as a spiral spring and has a winding cross section, wherein the balance spring is manufactured from an unmachined part, wherein the unmachined part is made of a ceramic material and is structured by means of a selective laser ablation method, such that the winding cross section of the spiral spring is in the form of a rhombus, the rhombus having at least four sides, two first corners with a first internal angle α, two second corners with a second internal angle β, a first diagonal, connecting the two first corners to one another, and a second diagonal, connecting the two second corners to one another, the first diagonal being shorter than the second diagonal, and the first internal angle being larger than the second internal angle.

17. The method according to claim 16, wherein the unmachined part is a disk.

18. The method according to claim 16, wherein the unmachined part has a thickness of 0.1 mm to 0.25 mm.

19. The method according to claim 16, wherein a first V-shaped groove is created by means of a laser on a first side of the unmachined part, wherein a second V-shaped groove is also created by means of a laser on the opposite second side of the unmachined part, such that the first and second grooves are situated congruently one above the other and together form an opening, which separates individual windings of the spiral spring from one another.

20. The method according to claim 16, wherein an ultrashort pulse laser is used to carry out the selective laser ablation method.

* * * * *